US009581102B2

(12) United States Patent
Nieddu

(10) Patent No.: US 9,581,102 B2
(45) Date of Patent: Feb. 28, 2017

(54) CONTROL APPARATUS FOR OPERATING A FUEL METERING VALVE

(71) Applicant: GM GLOBAL TECHNOLOGY OPERATIONS LLC, Detroit, MI (US)

(72) Inventor: Stefano Nieddu, Turin (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 381 days.

(21) Appl. No.: 14/446,071

(22) Filed: Jul. 29, 2014

(65) Prior Publication Data

US 2015/0027411 A1 Jan. 29, 2015

(30) Foreign Application Priority Data

Jul. 29, 2013 (GB) ..... 1313483.8

(51) Int. Cl.
*F02D 41/38* (2006.01)
*F02D 41/14* (2006.01)

(52) U.S. Cl.
CPC ..... *F02D 41/3845* (2013.01); *F02D 41/1401* (2013.01); *F02D 2041/141* (2013.01); *F02D 2041/1409* (2013.01); *F02D 2041/1433* (2013.01)

(58) Field of Classification Search
CPC .. F02M 59/366; F02M 59/367; F02M 59/368; F02M 63/0225; F02M 63/023; F02M 63/024; F02M 63/0245; F02D 2250/31; F02D 41/1401; F02D 41/3845; F02D 2041/1409; F02D 2041/141; F02D 2041/1433
USPC ..... 123/458
See application file for complete search history.

(56) References Cited

U.S. PATENT DOCUMENTS

| | | | | |
|---|---|---|---|---|
| 6,192,864 | B1 | 2/2001 | Nishimura | |
| 6,581,574 | B1 * | 6/2003 | Moran | F02D 41/2464 123/494 |
| 8,635,989 | B2 * | 1/2014 | Anetsberger | F02D 41/2464 123/447 |
| 2003/0127082 | A1 * | 7/2003 | Takahashi | F02D 41/221 123/704 |
| 2005/0103312 | A1 * | 5/2005 | Uchiyama | F02D 41/221 123/457 |
| 2005/0252200 | A1 * | 11/2005 | Oono | F02D 41/3845 60/285 |
| 2007/0034191 | A1 * | 2/2007 | Oono | F02D 41/3845 123/456 |

(Continued)

FOREIGN PATENT DOCUMENTS

| | | | |
|---|---|---|---|
| GB | 2387242 | A | 10/2003 |
| JP | 2009209888 | A | 9/2009 |
| WO | 2010131624 | A1 | 11/2010 |

*Primary Examiner* — Thomas Moulis
(74) *Attorney, Agent, or Firm* — Lorenz & Kopf LLP

(57) ABSTRACT

A method and control apparatus are disclosed for operating a fuel-metering valve associated to a fuel pump arranged to supply fuel into a fuel rail, the fuel-metering valve having a valve member and an electric actuator arranged to move that member for regulating a fuel flow-rate. The control apparatus includes an electronic control unit connected to the fuel-metering valve and configured to implement a method of control using a target value, a nominal function corrected value to set an adjustable parameter of a control signal for the fuel-metering valve.

13 Claims, 4 Drawing Sheets

(56) References Cited

U.S. PATENT DOCUMENTS

| | | | | |
|---|---|---|---|---|
| 2007/0079809 | A1* | 4/2007 | Oono | F02D 41/3845 123/456 |
| 2007/0295310 | A1* | 12/2007 | Achleitner | F02D 41/3082 123/495 |
| 2009/0093942 | A1* | 4/2009 | Okamoto | F02D 41/3845 701/103 |
| 2009/0299606 | A1* | 12/2009 | Dintino | F02D 41/2464 701/103 |
| 2010/0282213 | A1* | 11/2010 | Yoshikawa | F02D 33/006 123/456 |
| 2013/0166482 | A1* | 6/2013 | Veit | F02D 41/1402 706/12 |

* cited by examiner

CONTROL APPARATUS FOR OPERATING A FUEL METERING VALVE

CROSS REFERENCE TO RELATED APPLICATION

This application claims priority to GB Patent Application No. 1313483.8 filed Jul. 29, 2013, which is incorporated herein by reference in its entirety.

TECHNICAL FIELD

This technical field generally relates to a control apparatus for operating a fuel-metering valve provided for regulating the fuel flow-rate supplied by a fuel pump into a fuel rail of an automotive system.

BACKGROUND

Conventionally, an automotive system includes an internal combustion engine, such as for example a compression engine or a spark ignition engine. The internal combustion engine usually includes an engine block defining at least one cylinder having a piston, and a cylinder head that closes the cylinder and cooperates with the piston to define a combustion chamber. A fuel and air mixture is disposed in the combustion chamber and ignited, resulting in hot expanding exhaust gasses causing reciprocal movements of the piston, which rotates a crankshaft.

The fuel is provided by at least one fuel injector, which may be located inside the combustion chamber. The fuel injector receives the fuel from a fuel rail, which is in fluid communication with a high-pressure fuel pump that increases the pressure of the fuel received from a fuel source (tank). More particularly, the high-pressure fuel pump may include a reciprocating plunger, which is accommodated in a cylinder communicating with an inlet and with an outlet for the fuel. The plunger is actuated by a camshaft, which is driven by the crankshaft of the internal combustion engine. During expansion strokes of the plunger, the fuel is drawn from the inlet of the pump into the cylinder. During compression strokes, the fuel contained in the cylinder is supplied at higher pressure through the outlet of the pump into the fuel rail.

A fuel-metering valve is usually associated to the high-pressure fuel pump to regulate the fuel flow-rate, which is supplied into the fuel rail. The fuel-metering valve may be integrated in the high-pressure fuel pump, in order to realize a single device that is usually referred as fuel metering unit. The fuel-metering valve may be a suction control valve (SCV) or a digital valve.

A suction control valve is generally located at the inlet of the high-pressure fuel pump and includes a valve member that is movable between a closed position, which prevents the fuel to pass through the valve, and a fully open position, which allows a maximum amount of fuel to flow towards the fuel pump. The valve member is moved by an electric actuator, typically a solenoid that converts an electrical current into a magnetic field and then into a motion of the valve member. Depending on the energizing current, the valve member can assume any positions between the closed position and the fully open position. More particularly, some embodiments provide that if no electrical current is supplied to the actuator, the valve member remains in its fully open position. Progressively increasing the electrical current supplied to the actuator, the valve member moves towards its closed position. Other embodiments provide that if no electrical current is supplied to the actuator, the valve member remains in its closed position. Progressively increasing the electrical current supplied to the actuator, the valve member moves towards its fully open position. In both cases, the suction control valve regulates the flow-rate of the fuel, which is drawn inside the pump cylinder during the expansion strokes of the pump plunger.

A digital valve is generally located in a recirculation conduit that connects the cylinder of the high-pressure fuel pump back to the fuel tank. The digital valve includes a valve member, which during the compression stroke of the pump plunger, is moved between an open position and a closed position. As long as the valve member remains open, the pump plunger shoves the fuel from the pump cylinder into the recirculation conduit and then back into the fuel tank. As soon as the valve member is closed, the pump plunger increases the pressure of the fuel within the pump cylinder and supplies it into the fuel rail. The valve member is moved by an electric actuator, which is driven by a pulsed electric signal. In this way, varying the timing of the electric pulses that form the driving signal, the valve member can be closed in different instants during the compression stroke of the pump plunger, thereby regulating the volume of fuel, which is supplied into the fuel rail.

Regardless of how they actually work, the final effect of both digital valves and suction control valves is that of regulating the average flow rate of fuel that is globally supplied by the high-pressure pump into the fuel rail, and for this reason they are all classified as fuel metering valves.

Any fuel-metering valve is typically connected to a control apparatus of the automotive system, which includes several sensors and at least an electronic control unit (ECU). In order to operate the fuel metering valve, the electronic control unit is generally configured to perform a control cycle that includes the following steps: setting a target value of the fuel pressure inside the fuel rail, for example on the basis of the engine working conditions; determining a target value of the fuel flow-rate to be supplied into the fuel rail to meet the target value of the fuel rail pressure; determining a value of the adjustable parameter of the electric signal driving the fuel metering valve, namely the electrical current (for SCVs) or the timing of the electric pulses (for digital valves), that causes the high-pressure fuel pump to supply the target value of the fuel flow-rate; and finally setting the adjustable parameter of the electric signal at that determined value. More particularly, the target value of the fuel flow-rate is generally determined as the sum of two main contributions, namely a feed-forward contribution and a feedback contribution.

The feed-forward contribution is determined by means of an open loop approach that provides for using the target value of the fuel rail pressure as input of a mathematical model of the fuel rail, which yields as output a value of the fuel flow-rate indicative of the quantity of fuel that exits the fuel rail at the target pressure value, due to the operation of the fuel injectors and their leakages. The feed-back contribution is determined by means of a closed loop approach that provides for measuring a value of the pressure inside the fuel rail, for calculating an error between this measured value and the target value of the fuel rail pressure, and for using this error as input of a PI controller, which yields as output a value of the fuel flow-rate aimed to compensate the fuel pressure error.

Once the target value of the fuel flow-rate has been calculated, the corresponding value of the adjustable parameter of the electrical signal driving the fuel metering valve is determined according to another open loop, which provides for using the target value of the fuel flow-rate as input of a correlation function that yields as output a corresponding value of said adjustable parameter.

A drawback of this approach is that the correlation function is generally a nominal function, which is provided by the supplier of the fuel metering valve and which only represents a theoretical relationship between the fuel flow-rate and the adjustable parameter of the electrical signal driving the fuel metering valve, whereas the real behavior of each single fuel metering valve may be different due to production spreads, production tolerances and many other factors such as thermal drifts.

As a consequence, for a given target value of the fuel flow-rate, the nominal correlation function generally yields a nominal value of the adjustable parameter of the electrical driving signal which differs by an offset from the value that really allows the fuel metering valve to attain the target value of the fuel flow-rate.

This offset is currently compensated by the integral term of the PI controller, which adjusts the feedback contribution of the target value of the fuel flow-rate, so that under stable conditions the fuel-metering valve allows the high-pressure fuel pump to attain the correct fuel flow-rate. However, if the value of the offset is too big, this compensation may cause instability of the closed loop.

Moreover, if the target value of the fuel flow-rate changes abruptly, for example during fast transition phases, the PI controller may be not fast enough to compensate a possible change of the offset and a big error may arise between the target value and the real value of the fuel flow-rate supplied into the fuel rail.

SUMMARY

In view of the above, the present disclosure provides a control apparatus that can overcome or at least positively reduce the above-mentioned drawbacks achieved with a simple, rational and rather inexpensive solution.

In particular, an embodiment of the present disclosure provides a control apparatus for operating a fuel metering valve associated to a fuel pump arranged to supply fuel into a fuel rail, the fuel metering valve having a valve member and an electric actuator arranged to move the valve member for regulating a fuel flow-rate supplied by the fuel pump into the fuel rail, the control apparatus including an electronic control unit connected to the fuel metering valve. The electronic control unit configured to: determine a target value for the fuel flow-rate; use a nominal function, correlating values of the fuel flow-rate to corresponding values of an adjustable parameter of an electric signal driving the actuator of the fuel metering valve, to determine a nominal value of the adjustable parameter that corresponds to the target value of the fuel flow-rate; use the determined nominal value to calculate a corrected value of the adjustable parameter, and set the adjustable parameter of the electric signal at the corrected value. The electronic control unit is configured to calculate the corrected value of the adjustable parameter by estimating a value of the fuel flow-rate that approximates a real value thereof; calculating a difference between the target value and the estimated value of the fuel flow-rate; using said difference to determine a value of a correction term indicative of a deviation of the nominal function, and calculating the corrected value of the adjustable parameter as a function of the nominal value thereof and of the calculated value of the correction term.

As a result, the difference between the nominal value of the adjustable parameter and the real value thereof is continuously compensated by the correction term, thereby improving correlation of the target value the fuel flow-rate to the real value. In this way, the control apparatus can operate the fuel-metering valve efficiently during both stable and transient phases.

Particularly, the electronic control unit may be configured to determine the value of the correction term by: calculating a derivative of the nominal function at the point corresponding to the target value of the fuel flow-rate; calculating a derivative of the nominal function at the point corresponding to the estimated value of the fuel flow-rate; and calculating the correction term value as a function of said derivatives and of the difference between the target value and the estimated value of the fuel flow-rate. Since the value of the correction term is calculated taking into account the derivatives (slopes) of the nominal function, its compensation effect is effective even when the nominal function is not a linear one.

More particularly, the electronic control unit may be configured to calculate the value of the correction term by: calculating an average between the derivatives of the nominal function calculated at the points corresponding to the target value and to the estimated value of the fuel flow-rate; and multiplying the calculated average for the difference between the target value and the estimated value of the fuel flow-rate. This solution has the advantage of yielding a value of the correction term, which can bring the target value of the fuel flow-rate very close to the real value thereof for any operating point of the fuel-metering valve.

Still more particularly, the electronic control unit may be configured to calculate the average between the above-mentioned derivatives of the nominal function as a harmonic mean thereof. The advantage of this solution is that of further enhancing the reliability of the correction term value.

According to another aspect of the present disclosure, the electronic control unit may be configured to estimate the value of the fuel flow-rate by: measuring a value of a fuel rail pressure; and determining the estimated value of the fuel flow-rate on the basis of the measured value of the fuel rail pressure. This aspect of the present disclosure has the advantage of providing a simple solution for determining the estimated value of the fuel flow-rate.

Particularly, the electronic control unit may be configured to determine the estimated value of the fuel flow-rate using the measured value of the fuel rail pressure as input of a mathematical model that yields as output the estimated value of the fuel flow-rate. Provided that the mathematical model has a good approximation level, this solution may yield a very reliable estimated value of the fuel flow-rate.

According to another aspect of the present disclosure, the electronic control unit may be configured to determine the target value of the fuel flow-rate by: setting a target value for the fuel rail pressure; calculating a difference between the target value and the measured value of the fuel rail pressure; and calculating at least a feed-back contribution to the target value of the fuel flow-rate as a function of the calculated difference. This aspect of the present disclosure advantageously introduces a closed loop, which allows to continuously and precisely adjust the target value of the fuel flow-rate that is regulated by the fuel-metering valve.

Particularly, the electronic control unit may be configured to calculate the feed-back contribution using the difference between the target value and the measured value of the fuel rail pressure as input of a proportional-integrative (PI) controller that yields as output the feedback contribution. In this way the closed loop is advantageously configured to minimize the difference (error) between the target value and the measured real value of the fuel rail pressure.

In some embodiments the feedback contribution may coincide with the target value of the fuel flow-rate. In other words, the feedback contribution may be the sole contribution to the target value of the fuel flow-rate. In other embodiments, the electronic control unit may be configured to determine the target value of the fuel flow-rate by: calculating a feed-forward contribution to the target value of the fuel flow-rate on the basis of the target value of the fuel rail pressure; and adding the feed-forward contribution to the feed-back contribution of the fuel flow-rate. This solution has generally the advantage of improving the time response and the efficiency of the entire control logic.

Particularly, the electronic control unit may be configured to calculate the feed-forward contribution using the target value of the fuel rail pressure as input of a mathematical model that yields as output the feed-forward contribution. Provided that the mathematical model has a good approximation level, this solution may yield a reliable feed-forward contribution to the target value of the fuel flow-rate.

According to another aspect of this embodiment, the adjustable parameter of the electric signal driving the actuator of the fuel-metering valve may be an electrical current. This aspect is useful to allow the control apparatus to operate a fuel-metering valve embodied as a suction control valve.

According to another aspect of this embodiment, the adjustable parameter of the electric signal driving the actuator of the fuel-metering valve may be a timing of a sequence of electrical current pulses forming the signal. This aspect is useful to allow the control apparatus to operate a fuel-metering valve embodied as a digital valve. It should be observed that the timing of the electrical current pulses may be quantified in angular terms (e.g. the angular position of the camshaft driving the piston of the high-pressure pump).

Another embodiment of the present disclosure provides a method of operating a fuel metering valve associated to a fuel pump arranged to supply fuel into a fuel rail, the fuel metering valve having a valve member and an electric actuator arranged to move the valve member for regulating a fuel flow-rate supplied by the fuel pump into the fuel rail, the method including: determining a target value for the fuel flow-rate; using a nominal function, correlating values of the fuel flow-rate to corresponding values of an adjustable parameter of an electric signal driving the actuator of the fuel metering valve, to determine a nominal value of the adjustable parameter that corresponds to the target value of the fuel flow-rate; using the determined nominal value to calculate a corrected value of the adjustable parameter; and setting the adjustable parameter of the electric signal at the corrected value. The corrected value of the adjustable parameter is calculated by: estimating a value of the fuel flow-rate that approximates a real value thereof; calculating a difference between the target value and the estimated value of the fuel flow-rate; using said difference to determine a value of a correction term indicative of a deviation of the nominal function; and calculating the corrected value of the adjustable parameter as a function of the nominal value thereof and of the calculated value of the correction term. As a result of this solution, the difference between the nominal value of the adjustable parameter and the real value thereof is continuously compensated by the correction term, thereby guaranteeing that the target value of the fuel flow-rate is always very close to the real one.

In this way, the control method can operate the fuel-metering valve efficiently during both stable and transient phases. Particularly, the value of the correction term may be determined by: calculating a derivative of the nominal function at the point corresponding to the target value of the fuel flow-rate; calculating a derivative of the nominal function at the point corresponding to the estimated value of the fuel flow-rate; and calculating the correction term value as a function of said derivatives and of the difference between the target value and the estimated value of the fuel flow-rate. Since the value of the correction term is calculated taking into account the derivatives (slopes) of the nominal function, its compensation effect is effective even when the nominal function is not a linear one.

More particularly, the value of the correction term may be calculated by: calculating an average between the derivatives of the nominal function calculated at the points corresponding to the target value and to the estimated value of the fuel flow-rate; and multiplying the calculated average for the difference between the target value and the estimated value of the fuel flow-rate. This solution has the advantage of yielding a value of the correction term, which can bring the target value of the fuel flow-rate very close to the real value thereof for any operating point of the fuel-metering valve.

Still more particularly, the average between the above mentioned derivatives of the nominal function may be calculated as an harmonic mean thereof. The advantage of this solution is that of further enhancing the reliability of the correction term value.

According to another aspect of the present disclosure, the value of the fuel flow-rate may be estimated by: measuring a value of a fuel rail pressure; and determining the estimated value of the fuel flow-rate on the basis of the measured value of the fuel rail pressure. This aspect of the present disclosure has the advantage of providing a simple solution for determining the estimated value of the fuel flow-rate.

Particularly, the estimated value of the fuel flow-rate may be determined using the measured value of the fuel rail pressure as input of a mathematical model that yields as output the estimated value of the fuel flow-rate. Provided that the mathematical model has a good approximation level, this solution may yield a very reliable estimated value of the fuel flow-rate.

According to another aspect of the present disclosure, the target value of the fuel flow-rate may be determined by: setting a target value for the fuel rail pressure; calculating a difference between the target value and the measured value of the fuel rail pressure; and calculating at least a feed-back contribution to the target value of the fuel flow-rate as a function of the calculated difference. This aspect of the present disclosure advantageously introduces a closed loop, which allows to continuously and precisely adjust the target value of the fuel flow-rate that is regulated by the fuel-metering valve.

Particularly, the feedback contribution may be calculated using the difference between the target value and the measured value of the fuel rail pressure as input of a proportional-integrative (PI) controller that yields as output the feedback contribution. In this way the closed loop is advantageously configured to minimize the difference (error) between the target value and the measured real value of the fuel rail pressure.

In some embodiments the feedback contribution may coincide with the target value of the fuel flow-rate. In other words, the feedback contribution may be the sole contribution to the target value of the fuel flow-rate. In other embodiments, the target value of the fuel flow-rate may be determined by: calculating a feed-forward contribution to the target value of the fuel flow-rate on the basis of the target value of the fuel rail pressure; and adding the feed-forward contribution to the feed-back contribution of the fuel flow-rate. This solution has generally the advantage of improving the time response and the efficiency of the entire control logic. Particularly, the feed-forward contribution may be calculated using the target value of the fuel rail pressure as input of a mathematical model that yields as output the feed-forward contribution. Provided that the mathematical model has a good approximation level, this solution may yield a reliable feed-forward contribution to the target value of the fuel flow-rate.

According to another aspect of this embodiment, the adjustable parameter of the electric signal driving the actuator of the fuel-metering valve may be an electrical current. This aspect is useful to allow the method to operate a fuel-metering valve embodied as a suction control valve.

According to another aspect of this embodiment, the adjustable parameter of the electric signal driving the actuator of the fuel-metering valve may be a timing of a sequence of electrical current pulses forming the signal. This aspect is useful to allow the method to operate a fuel-metering valve embodied as a digital valve.

It should be observed that the timing of the electrical current pulses may be quantified in angular terms (e.g. the angular position of the camshaft driving the piston of the high-pressure pump).

The method according to all the embodiments of the present disclosure can be carried out with the help of a computer program including a program-code for carrying out the method described above, and in the form of a computer program product including the computer program. The method can be also embodied as an electromagnetic signal, said signal being modulated to carry a sequence of data bits which represent a computer program to carry out all steps of the method.

Another embodiment of the present disclosure provides an apparatus for operating a fuel metering valve associated to a fuel pump arranged to supply fuel into a fuel rail, the fuel metering valve having a valve member and an electric actuator arranged to move the valve member for regulating a fuel flow-rate supplied by the fuel pump into the fuel rail, the apparatus including: means for determining a target value for the fuel flow-rate; means for using a nominal function, correlating values of the fuel flow-rate to corresponding values of an adjustable parameter of an electric signal driving the actuator of the fuel metering valve, to determine a nominal value of the adjustable parameter that corresponds to the target value of the fuel flow-rate; means for using the determined nominal value to calculate a corrected value of the adjustable parameter; and means for setting the adjustable parameter of the electric signal at the corrected value. The means for calculating the corrected value of the adjustable parameter include: means for estimating a value of the fuel flow-rate that approximates a real value thereof; means for calculating a difference between the target value and the estimated value of the fuel flow-rate; means for using said difference to determine a value of a correction term indicative of a deviation of the nominal function; and means for calculating the corrected value of the adjustable parameter as a function of the nominal value thereof and of the calculated value of the correction term.

As a result of this solution, the difference between the nominal value of the adjustable parameter and the real value thereof is continuously compensated by the correction term, thereby guaranteeing that the target value of the fuel flow-rate is always very close to the real one. In this way, the apparatus can operate the fuel-metering valve efficiently during both stable and transient phases.

Particularly, the means for determining the value of the correction term may include: means for calculating a derivative of the nominal function at the point corresponding to the target value of the fuel flow-rate; means for calculating a derivative of the nominal function at the point corresponding to the estimated value of the fuel flow-rate; and means for calculating the correction term value as a function of said derivatives and of the difference between the target value and the estimated value of the fuel flow-rate. Since the value of the correction term is calculated taking into account the derivatives (slopes) of the nominal function, its compensation effect is effective even when the nominal function is not a linear one.

More particularly, the means for calculating the value of the correction term may include: means for calculating an average between the derivatives of the nominal function calculated at the points corresponding to the target value and to the estimated value of the fuel flow-rate; and means for multiplying the calculated average for the difference between the target value and the estimated value of the fuel flow-rate. This solution has the advantage of yielding a value of the correction term, which can bring the target value of the fuel flow-rate very close to the real value thereof for any operating point of the fuel-metering valve.

Still more particularly, the means for calculating the average between the above mentioned derivatives of the nominal function may include means for calculating an harmonic mean thereof. The advantage of this solution is that of further enhancing the reliability of the correction term value.

According to another aspect of the present disclosure, the means for estimating the value of the fuel flow-rate may include: means for measuring a value of a fuel rail pressure; and means for determining the estimated value of the fuel flow-rate on the basis of the measured value of the fuel rail pressure. This aspect of the present disclosure has the advantage of providing a simple solution for determining the estimated value of the fuel flow-rate.

Particularly, the means for determining the estimated value of the fuel flow-rate may include means for using the measured value of the fuel rail pressure as input of a mathematical model that yields as output the estimated value of the fuel flow-rate. Provided that the mathematical model has a good approximation level, this solution may yield a very reliable estimated value of the fuel flow-rate.

According to another aspect of the present disclosure, the means for determining the target value of the fuel flow-rate may include: means for setting a target value for the fuel rail pressure; means for calculating a difference between the target value and the measured value of the fuel rail pressure; and means for calculating at least a feed-back contribution to the target value of the fuel flow-rate as a function of the calculated difference. This aspect of the present disclosure advantageously introduces a closed loop, which allows to continuously and precisely adjust the target value of the fuel flow-rate that is regulated by the fuel-metering valve.

Particularly, the means for calculating the feedback contribution may include means for using the difference between the target value and the measured value of the fuel rail pressure as input of a proportional-integrative (PI) controller that yields as output the feedback contribution. In this way the closed loop is advantageously configured to minimize the difference (error) between the target value and the measured real value of the fuel rail pressure.

In some embodiments the feedback contribution may coincide with the target value of the fuel flow-rate. In other words, the feedback contribution may be the sole contribution to the target value of the fuel flow-rate. In other embodiments, the means for determining the target value of the fuel flow-rate may include: means for calculating a feed-forward contribution to the target value of the fuel flow-rate on the basis of the target value of the fuel rail pressure; and means for adding the feed-forward contribution to the feed-back contribution of the fuel flow-rate. This solution has generally the advantage of improving the time response and the efficiency of the entire control logic.

Particularly, the means for calculating the feed-forward contribution may include means for using the target value of the fuel rail pressure as input of a mathematical model that yields as output the feed-forward contribution. Provided that the mathematical model has a good approximation level, this solution may yield a reliable feed-forward contribution to the target value of the fuel flow-rate.

According to another aspect of this embodiment, the adjustable parameter of the electric signal driving the actuator of the fuel-metering valve may be an electrical current. This aspect is useful to allow the apparatus to operate a fuel-metering valve embodied as a suction control valve.

According to another aspect of this embodiment, the adjustable parameter of the electric signal driving the actuator of the fuel-metering valve may be a timing of a sequence of electrical current pulses forming the signal. This aspect is useful to allow the apparatus to operate a fuel-metering valve embodied as a digital valve. It should be observed that the timing of the electrical current pulses may be quantified in angular terms (e.g. the angular position of the camshaft driving the piston of the high-pressure pump).

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
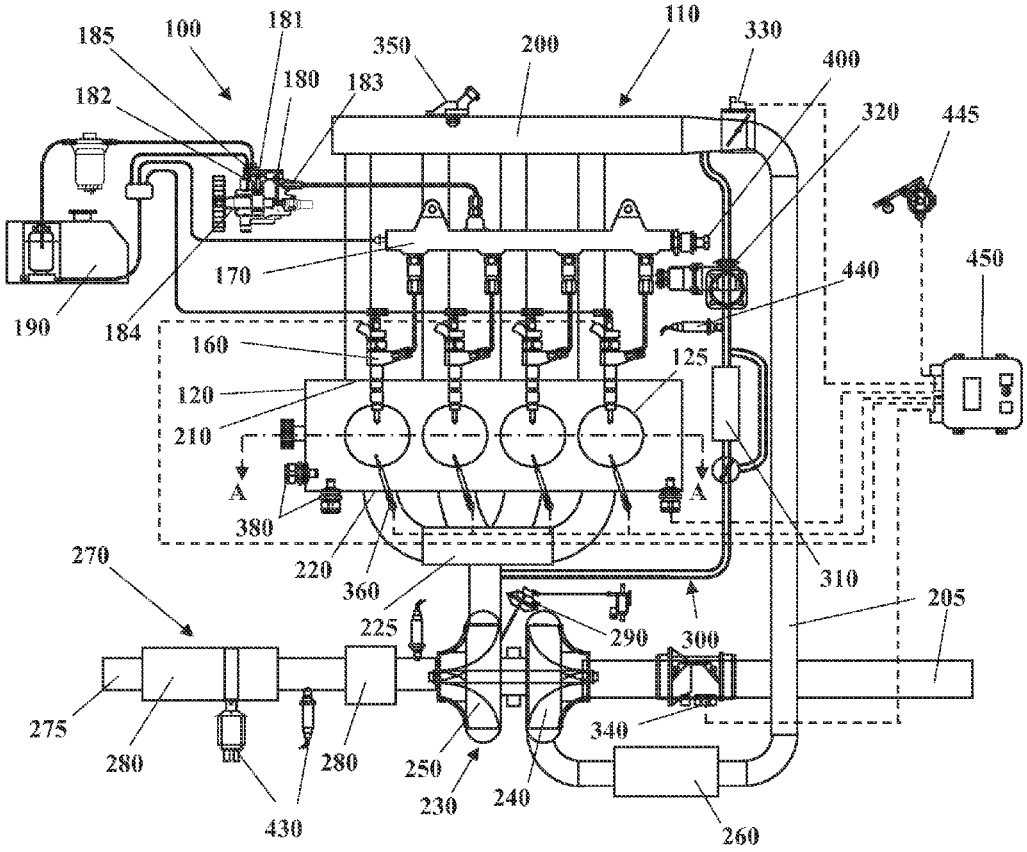
FIG. 1 schematically shows a powertrain of an automotive system.
Figure 2:
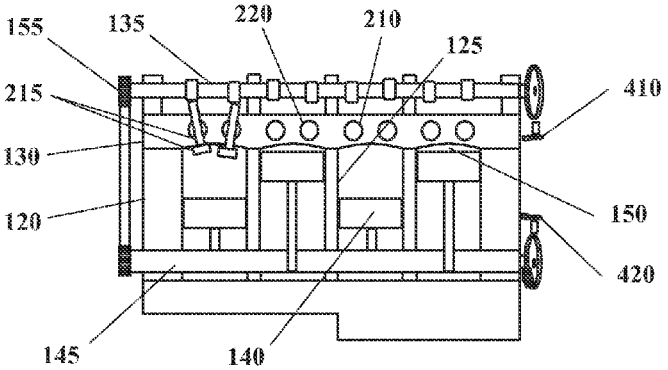
FIG. 2 is the section A-A of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbo-charger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after-treatment devices 280. The after-treatment devices may be any device configured to change the composition of the exhaust gases. Some examples of after-treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The fuel is provided at high-pressure to the fuel injector 160 from a fuel rail 170 in fluid communication with a high-pressure fuel pump 180 that increase the pressure of the fuel received from a fuel source 190.

The high-pressure fuel pump 180 may include at least a reciprocating plunger 181, which is accommodated in a cylinder communicating with an inlet 182 and with an outlet 183 for the fuel. The plunger 181 may be moved by a camshaft 184, which may be driven by the crankshaft 145 of the internal combustion engine 110. During expansion strokes of the plunger 181, the fuel is drawn from the inlet 182 into the cylinder. During compression strokes, the fuel contained in the cylinder is supplied at higher pressure through the outlet 183 into the fuel rail 170.

A fuel-metering valve 185 is usually associated to the high-pressure fuel pump 180 to regulate the (average) flow-rate of fuel, which is supplied to the fuel rail 170. In some embodiments, the fuel-metering valve 185 may be integrated in the high-pressure fuel pump 180, in order to realize a single device that is usually referred as a fuel-metering unit.

Figure 3:
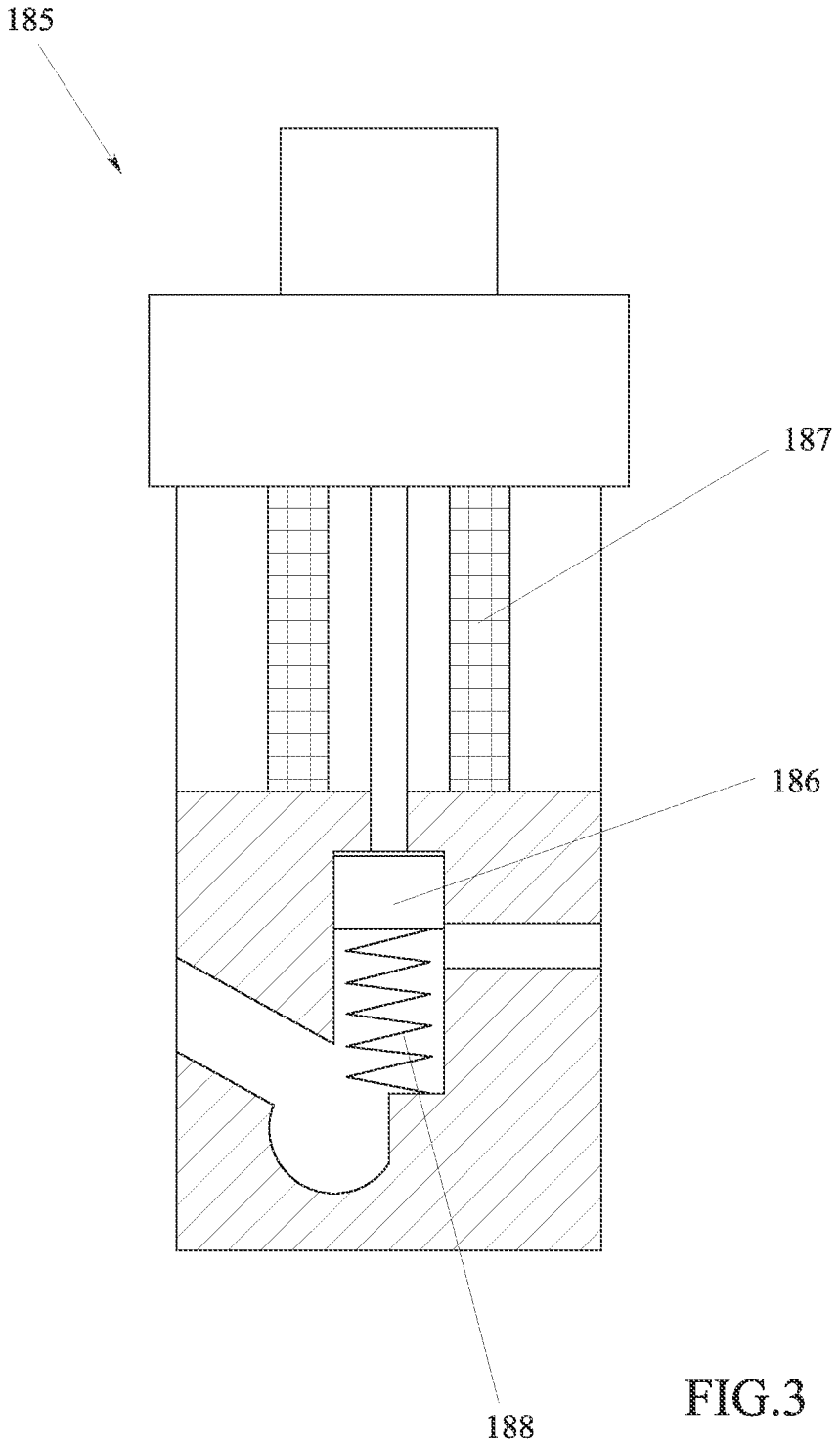
FIG. 3 schematically shows a cross-section of a fuel metering valve.

The fuel metering valve 185 may be a suction control valve (SCV) located at the inlet 185 of the high-pressure fuel pump 180. As shown in FIG. 3, the suction control valve may include a valve member 186 that is movable between a closed position, which prevents the fuel to pass through the valve, and a fully open position, which allows a maximum amount of fuel to flow towards the fuel pump. The valve member 186 is moved by an electric actuator 187, for example a solenoid that converts an electrical energizing current into a magnetic field and then into a motion of the valve member 186. Depending on the energizing current, the valve member 186 can assume any positions between the closed position and the fully open position. More particularly, if no electrical current is supplied to the actuator 187, the valve member 186 remains in its fully open position thanks to a spring 188. Progressively increasing the electrical current supplied to the actuator 187, the valve member 186 moves towards its closed position. In this way, the fuel metering valve 185 is able to regulate the flow-rate of fuel which is drawn inside the pump cylinder during the expansion strokes of the pump plunger 181 and consequently the (average) flow rate of fuel which is supplied by the high-pressure fuel pump 180 into the fuel rail 170.

Figure 5:
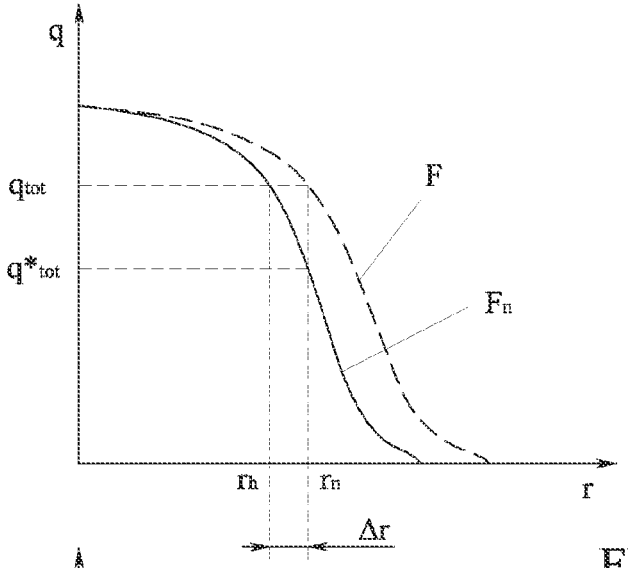
FIG. 5 is a graph showing a nominal and a real correlation function between the fuel flow-rate supplied into the fuel rail and the electric current driving the fuel metering valve, wherein the fuel metering valve supplies more fuel than expected.

An ideal relationship between the electrical current supplied to the actuator 187 of the fuel metering valve 185 and the correspondent fuel flow-rate supplied by the high-pressure pump 180 into the fuel rail 170 is represented by the nominal correlation function $F_n$ plotted in the diagram of FIG. 5, wherein r indicates the electrical current and q the value of the fuel flow-rate. This nominal correlation function $F_n$ is generally a standard function determined by the supplier of the fuel-metering valve 185, which approximates the behavior of all the fuel metering valves of the same kind. As a consequence, due to production spreads, production tolerances and many other factors, the nominal correlation function $F_n$ may not exactly coincide with the real correlation function F of the specific fuel metering valve 185, which is generally unknown.

It should be observed that in other embodiments, the suction control valve may be arranged to operate at the opposite of what has been previously explained: if no electrical current is supplied to the actuator, the valve member remains in its closed position, whilst progressively increasing the electrical current supplied to the actuator, the valve member moves towards its fully open position.

In still other embodiments, the fuel-metering valve 185 may be a digital valve (not shown in the figures) located in a recirculation conduit that connects the cylinder of the high-pressure fuel pump 180 back to the fuel source 190. The digital valve may include a valve member, which during the compression stroke of the pump plunger 181, is moved between an open position and a closed position. As long as the valve member remains open, the pump plunger 181 shoves the fuel from the pump cylinder into the recirculation conduit and then back into the fuel source 190. As soon as the valve member is closed, the pump plunger 181 increases the pressure of the fuel within the pump cylinder and supplies it into the fuel rail 170. The valve member of the digital valve is moved by an electric actuator, which is driven by a pulsed electric signal. In this way, varying the timing of the electric pulses that form the driving signal, the valve member can be closed in different instants during the compression stroke of the pump plunger 181, thereby regulating the volume of fuel which is supplied into the fuel rail 170 per cycle, and thus the (average) flow rate of fuel which is supplied by the high-pressure pump 180 intro the fuel rail 170.

Also the digital valve is generally provided with a nominal correlation function $F_n$, which represents an ideal relationship between the timing of the electric pulses and the correspondent fuel flow-rate supplied by the high-pressure pump 180 into the fuel rail 170. This nominal correlation function $F_n$ may be similar to that plotted in FIG. 5, provided that the coordinate r represents the timing of the electric pulses forming the driving signal. In this regard, it should be noted that the timing of the electric pulses may be quantified in angular terms, for example by the angular position of the camshaft 184 actuating the plunger 181 of the high-pressure pump 180 at the instant in which the electric pulse causes the valve member to move in open position.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, the cam phaser 155, and the fuel-metering valve 185. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The memory system may contains programs and many other data, including for example the nominal correlation function F of the fuel metering valve 185. The CPU is configured to retrieve data and execute instructions stored as a program in the memory system, and send and receive signals to/from the interface bus. The memory system may include various storage types including optical storage, magnetic storage, solid-state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

Figure 4:
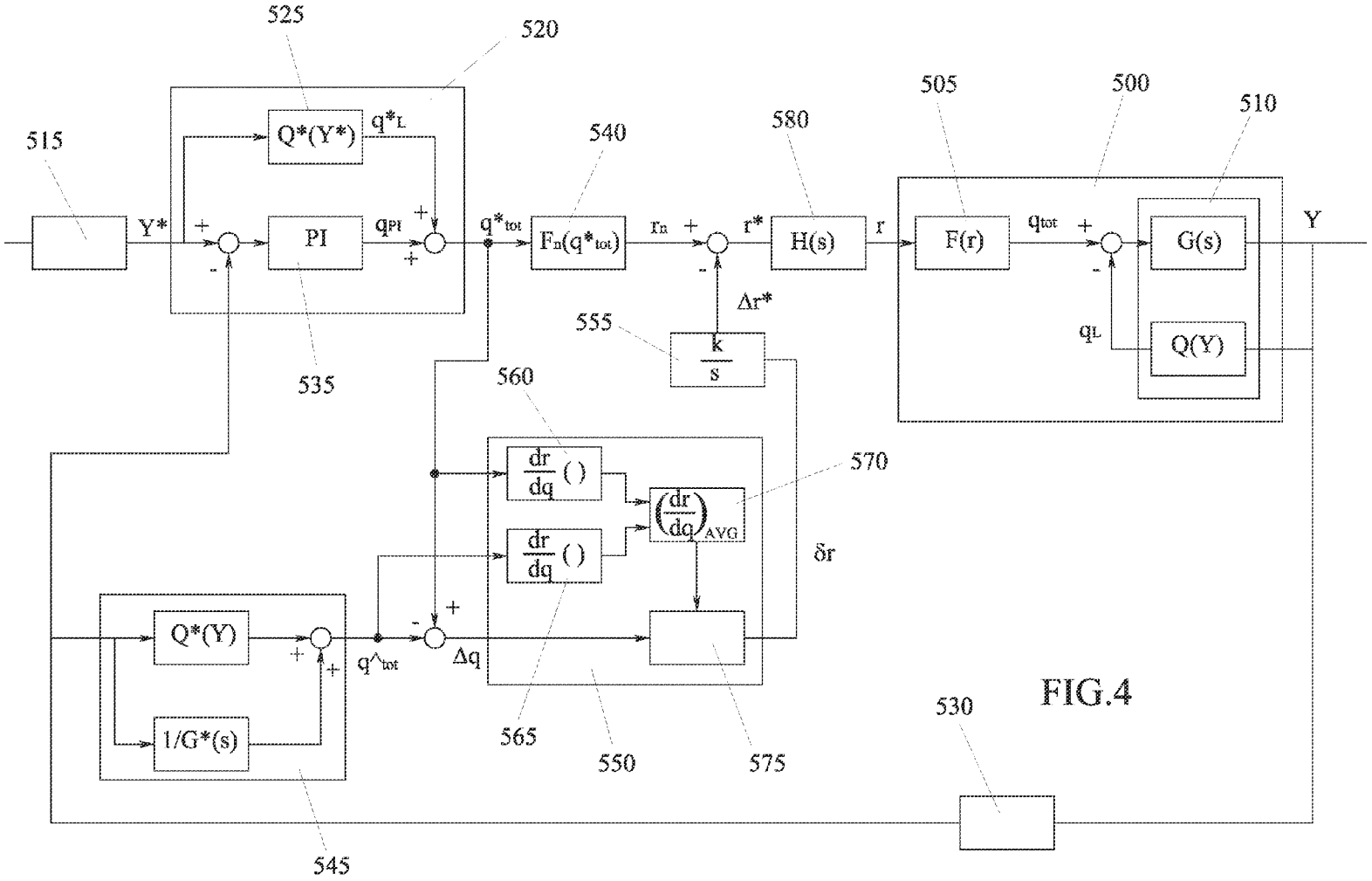
FIG. 4 is the Laplace block diagram of a control strategy for a fuel metering valve according to an embodiment of the present disclosure.

According to an embodiment of the present disclosure, the ECU 450 is configured to operate the fuel-metering valve 185 according to the closed-loop control strategy represented by the Laplace block diagram of FIG. 4.

In this Laplace block diagram, the block 500 globally represents the operation of the real system including the fuel metering valve 185, the high-pressure fuel pump 180 and the fuel rail 170. The block 500 receives as input a real value r of the electrical current driving the fuel-metering valve 185 and yields as output a real value Y of the fuel pressure within the fuel rail 170.

In greater details, the block 500 includes a block 505 that represents the both the fuel metering valve 185 and the high-pressure fuel pump 180. The block 505 receives as input the real value r of the electrical current driving the fuel-metering valve 185 and yields as output a real value $q_{tot}$ of the fuel flow-rate, which is supplied into the fuel rail 170. The relation between the real value r of the electrical current and the real value $q_{tot}$ of the fuel flow-rate is represented by the real correlation function F, which generally does not exactly coincide with the nominal correlation function $F_n$ mentioned above and which is unknown.

The fuel rail 170 is represented by the block 510. During the operation of the real system, the fuel rail 170 receives the real value $q_{tot}$ of the fuel flow-rate, which is supplied by the high-pressure fuel pump 180 in association with the fuel-metering valve 185. Contemporaneously, a real value $q_L$ of fuel flow-rate exits the fuel rail 170 due to the operation of the fuel injectors 160 and their leakages. The real value $q_L$ of the fuel flow-rate exiting the fuel rail 170 depends on the real value Y of the fuel rail pressure, according to a real load function Q that is unknown. The difference between the real value $q_{tot}$ of the fuel flow-rate entering the fuel rail 170 and the real value $q_L$ of the fuel flow-rate exiting the fuel rail 170 determines the real value Y of the fuel rail pressure. The relation between the difference $q_{tot}$-$q_L$ and the real value Y of the fuel rail pressure is represented by a real transfer function G of the fuel rail 170 that is unknown too.

In order to control the operation of the above described real system, the control strategy provides for setting (block 515) a target value Y* of the pressure to be achieved inside the fuel rail 170. This target value Y* of the fuel rail pressure may be determined by the ECU 450 on the basis of the engine operating conditions, according to a conventional strategy. The target value Y* of the fuel rail pressure is then used in the block 520, to determine a target value $q^*_{tot}$ of the fuel flow-rate that should be supplied into the fuel rail 170 in order to achieve the target value Y* of the fuel rail pressure.

According to this embodiment, the target value $q^*_{tot}$ of the fuel flow-rate may be calculated by the ECU 450 as the sum of two contributions, namely a feed-forward contribution $q^*_L$ and a feedback contribution $q_{PI}$.

The feed-forward contribution $q^*_L$ represents an estimation of the fuel flow-rate that exits the fuel rail 170 (due to the fuel injectors 160 and the leakages), if the real fuel rail pressure is equal to the target value Y*. The feed-forward contribution $q^*_L$ may be calculated (block 525) by means of a mathematical model Q*, for example a function, that approximates the real load function Q correlating the fuel rail pressure and the fuel flow-rate exiting the fuel rail 170. The mathematical model Q* may be determined through experimental activities performed on a test bench and may be stored as a data item in the memory system connected to the ECU 450.

To calculate the feedback contribution $q_{PI}$, the control strategy provides for measuring (block 530) the real value Y of the fuel rail pressure. The real value Y of the fuel rail pressure may be measured by the ECU 450 through the fuel rail pressure sensor 400. The real value Y of the fuel rail pressure is then fed-back and compared with the target value Y*, in order to calculate an error (i.e. difference) between the target value Y* and the measured value Y of the fuel rail pressure. The error is then used as input of a proportional-integrative (PI) controller 535 that yields as output the feed-back contribution $q_{PI}$ of the target value $q^*_{tot}$ of the fuel flow-rate. In this way, the general effect of the feedback contribution $q_{PI}$ is that of minimizing the difference between the target value Y* and the measured value Y of the fuel rail pressure.

The target value $q^*_{tot}$ of the fuel flow-rate is then used to calculate (block 540) a nominal value $r_n$ of the electrical current driving the fuel metering valve 185, which should allow the high-pressure fuel pump 180 to deliver the target value $q^*_{tot}$ of the fuel flow-rate. The nominal value $r_n$ may be calculated according to an open loop approach, using the nominal correlation function $F_n$ of the fuel-metering valve 185. In other words, the target value $q^*_{tot}$ of the fuel flow-rate may be used as input of the nominal function $F_n$ that yields as output the corresponding nominal value $r_n$ of the electrical current.

However, it has already been mentioned that the nominal correlation function $F_n$ generally does not coincide with the real correlation function F of the fuel-metering valve 185. As a consequence, the nominal value $r_n$ of the electrical current magnitude generally does not allow the high-pressure fuel pump 180 to really supply the target value $q^*_{tot}$ of the fuel flow-rate.

By way of example, FIG. 5 represents a case in which the fuel metering valve 185 causes the high-pressure fuel pump 180 to supply more fuel than expected, so that the graph of the real correlation function F is shifted at the right of the graph of the nominal correlation function $F_n$. It is apparent that, for a given target value $q^*_{tot}$ of the fuel flow-rate, the nominal correlation function $F_n$ yields a nominal value $r_n$ of the electrical current that causes the high-pressure fuel pump 180 to supply a real value $q_{tot}$ of the fuel flow-rate which is higher than the target value $q^*_{tot}$. In other words, the nominal value $r_n$ of the electrical current magnitude causes a real value $q_{tot}$ of the fuel flow-rate, which, according to the nominal correlation function $F_n$, should correspond to a lower hypothetic value $r_h$ of the electrical current. The difference between the hypothetic value $r_h$ and the nominal value $r_n$ of the electrical current represents a negative offset $\Delta r$ between the nominal correlation function $F_n$ and the real correlation function F at the point corresponding to the real value $q_{tot}$ of the fuel flow-rate.

Figure 6:
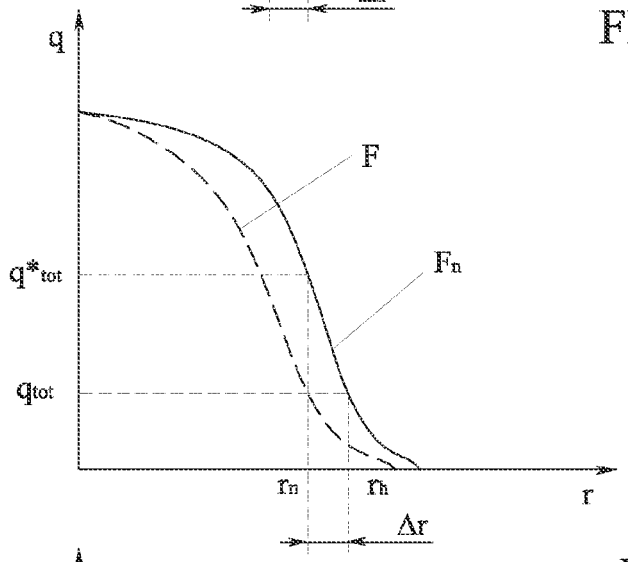
FIG. 6 is a graph showing a nominal and a real correlation function between the fuel flow-rate supplied into the fuel rail and the electric current driving the fuel metering valve, wherein the fuel metering valve supplies less fuel than expected.

Similarly, FIG. 6 represents a case in which the fuel metering valve 185 causes the high-pressure fuel pump 180 to supply less fuel than expected, so that the graph of the real correlation function F is shifted at the left of the graph of the nominal correlation function $F_n$. It is apparent that in this case, for a given target value $q^*_{tot}$ of the fuel flow-rate, the nominal correlation function $F_n$ yields a nominal value $r_n$ of the electrical current that causes the high-pressure fuel pump 180 to supply a real value $q_{tot}$ of the fuel flow-rate which is lower than the target value $q^*_{tot}$. In other words, the nominal value $r_n$ of the electrical current magnitude causes a real value $q_{tot}$ of the fuel flow-rate, which, according to the nominal correlation function $F_n$, should correspond to a higher hypothetic value $r_h$ of the electrical current. The difference between the hypothetic value $r_h$ and the nominal value $r_n$ of the electrical current represents a positive offset $\Delta r$ between the nominal correlation function $F_n$ and the real correlation function F at the point corresponding to the real value $q_{tot}$ of the fuel flow-rate.

In order to compensate the offset $\Delta r$, the control strategy provides for using the real measured value Y of the fuel rail pressure to estimate (block 545) a value $\hat{q}_{tot}$ that approximates the real value $q_{tot}$ of the fuel flow-rate that has been supplied into the fuel rail 170 by the high-pressure fuel pump 180 in association with the fuel metering valve 185. The value $\hat{q}_{tot}$ of the fuel flow-rate can be estimated using the mathematical model Q*, which approximates the real load function Q between the fuel rail pressure and the fuel flow-rate exiting the fuel rail 170, and another mathematical model G*, which approximates the real transfer function G of the fuel rail 170. The mathematical model G* may be determined through experimental activities performed on a test bench and may be stored as a data item in the memory system connected to the ECU 450.

In particular, the estimated value $\hat{q}$tot of the fuel flow-rate can be calculated with the following transfer function:

$$\hat{q}_{tot} = Q^*(Y) + \frac{Y}{G^*(s)} \cong q_{tot}.$$

It should be understood that the reliability of this estimation depends on the approximation level of the models Q* and G*.

The estimated value $\hat{q}_{tot}$ of the fuel flow-rate is then compared to the target value $q^*_{tot}$ of the fuel flow-rate, in order to calculate a difference $\Delta q$ between them:

$$\Delta q = q^*_{tot} - \hat{q}_{tot}.$$

The difference $\Delta q$, the target value $q^*_{tot}$ of the fuel flow-rate and the estimated value $\hat{q}_{tot}$ of the fuel flow-rate, may then be used in the block 550 to calculate a value $\delta r$ of a compensation error, which is subsequently used as input of an integral regulator 555 that yields as output an accumulated value $\Delta r^*$ of a correction term that approximates the offset $\Delta r$ between the nominal correlation function $F_n$ and the real correlation function F. The transfer function of the integral regulator 555 may be of the kind $$\frac{k}{s}$$

wherein k is the integrator gain.

According to this scheme, the compensation error $\delta r$ represents an instantaneous amount of electrical current that still need to be compensated in order that the accumulated value $\Delta r^*$ of the correction term is equal to the real offset $\Delta r$.

To calculate the compensation error, the calculation block 550 may include a block 560 that calculates the derivative (slope)

$$\frac{\partial r}{\partial q}$$

($q^*_{tot}$) of the nominal correlation function $F_n$ of the fuel metering valve 185 at the point corresponding to the target value $q^*_{tot}$ of the fuel flow-rate. The calculation block 550 may further include a block 565 that calculates the derivative (slope)

$$\frac{\partial r}{\partial q}$$

($\hat{q}_{tot}$) of the nominal correlation function $F_n$ of the fuel metering valve 185 at the point corresponding to the estimated value $\hat{q}_{tot}$ of the fuel flow-rate. The derivatives $$\frac{\partial r}{\partial q}$$

($q^*_{tot}$) and $$\frac{\partial r}{\partial q}$$

($\hat{q}_{tot}$) may men be used as input of a block 570 that calculates an average value thereof $$\left(\frac{\partial r}{\partial q}\right)_{AVG}.$$

By way of example, the average value $$\left(\frac{\partial r}{\partial q}\right)_{AVG}$$

may be calculated as an harmonic mean of the derivatives $$\frac{\partial r}{\partial q}$$

($q^*_{tot}$) and $$\frac{\partial r}{\partial q}$$

($\hat{q}_{tot}$), according to the following equation:

$$\left(\frac{\partial r}{\partial q}\right)_{AVG} = \frac{2}{\left(\frac{1}{\frac{\partial r}{\partial q}(q^*_{tot})} + \frac{1}{\frac{\partial r}{\partial q}(\hat{q}_{tot})}\right)}.$$

This harmonic mean can be useful to maximize the gain k of the integrative regulator 555, but also a geometric or an arithmetic mean can be effective instead.

The calculation block 550 may finally include a block 575 that receives as input the difference Δq and the average slope $$\left(\frac{\partial r}{\partial q}\right)_{AVG}$$

of the nominal correlation function F to calculate the value δr of the compensation error according to the following equation:

$$\delta r = \Delta q \cdot \left(\frac{\partial r}{\partial q}\right)_{AVG} = (q^*_{tot} - \hat{q}_{tot}) \cdot \left(\frac{\partial r}{\partial q}\right)_{AVG}.$$

Figure 7:
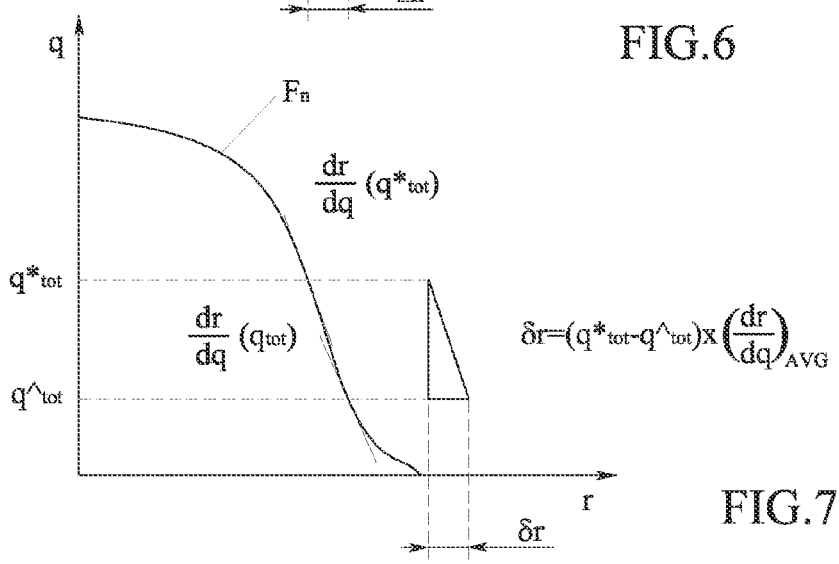
FIG. 7 is a graph showing the geometrical representation of ðr on the nominal correlation function of FIG. 6.

The geometrical representation of this calculation, referred to the explanatory case of FIG. 6, is illustrated in FIG. 7. It can be seen that the difference Δq represents a first cathetus of a right-angled triangle, whose hypotenuse has a slope correspondent to the average slope $$\left(\frac{\partial r}{\partial q}\right)_{AVG}$$

of the nominal correlation function $F_n$. As a consequence, the value δr of the compensation error is the second cathetus of the above-mentioned triangle and represents the residual error between the nominal correlation function $F_n$ and the real correlation function F.

It should be observed that in other simplified embodiments, the compensation error value δr may be simply equal to difference Δq, namely the difference Δq may be directly used as input of the integral regulator 555.

Coming back to FIG. 5, the accumulated value Δr* of the correction term yielded as output by the integrative regulator 555 is subtracted from the nominal value $r_n$ of the electrical current yielded by the nominal correlation function $F_n$, in order to calculate a corrected value r* of that electrical current that compensates for the offset Δr between the nominal correlation function $F_n$ and the real correlation function F.

The corrected value r* of that electrical current is then used as input for a driving 580 of the fuel metering valve 185, which regulates the real value r of the electrical current supplied to the actuator (solenoid) 187 accordingly. The driving 580 may be for example a closed loop control of the current flowing through the actuator (solenoid) 187. For the purpose of this disclosure, the transfer function H of this driving 580 can be considered unitary so that r*≅r.

As a result of the above described control scheme, the offset Δr between the nominal correlation function $F_n$ and the real correlation function F of the fuel metering valve 185 is continuously compensated, so that for any operating point the real value $q_{tot}$ of the fuel flow-rate supplied into the fuel rail 170 substantially coincide with the target value $q^*_{tot}$ requested by the ECU 450. Since the value Δr* of the correction term is calculated taking into account the derivative (slope) of the nominal correlation function $F_n$, its compensation effect is effective even when the nominal function $F_n$ is not a linear one (as shown in FIGS. 5, 6 and 7). As a consequence, changing the target value Y* of the fuel rail pressure will not produce a transient error magnification and the PI controller 535 will not change its value sensibly, thereby increasing the stability of the entire closed loop control system.

As already mentioned, the control scheme illustrated in FIG. 4 and described above can be used also if the fuel metering valve 185 is a digital valve, provided that the parameter indicated as r represents the timing of the electrical pulses driving the valve actuator. In such a case, the offset Δr between the nominal correlation function $F_n$ and the real correlation function F may however depend on the rotational speed of the engine crankshaft 145 that drives the camshaft of the high-pressure fuel pump 180. For this reason, the output of the integral regulator 555 may be used as input of an additional proportional regulator (not shown in the figures), which calculates the value Δr* of the correction term multiplying the output of the integral regulator 555 for a coefficient proportional to the rotational speed of the crankshaft 145, wherein the rotational speed of the crankshaft 145 may be measured through the crank position sensor 420.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A control apparatus for operating a fuel metering valve associated to a fuel pump arranged to supply fuel into a fuel rail, the fuel metering valve having a valve member and an electric actuator arranged to move the valve member for regulating a fuel flow-rate supplied by the fuel pump into the fuel rail, the control apparatus comprising an electronic control unit connected to the fuel metering valve and configured to:

determine a target value ($q^*_{tot}$) for the fuel flow-rate;

use a nominal function ($F_n$), correlating values of the fuel flow-rate to corresponding values of an adjustable parameter of an electric signal driving the actuator of the fuel metering valve, to determine a nominal value ($r_n$) of the adjustable parameter that corresponds to the target value ($q^*_{tot}$) of the fuel flow-rate;

use the determined nominal value ($r_n$) to calculate a corrected value (r*) of the adjustable parameter; and set the adjustable parameter of the electric signal at the corrected value (r*);

wherein the electronic control unit is configured to calculate the corrected value (r*) of the adjustable parameter by:

estimating a value ($\hat{q}_{tot}$) of the fuel flow-rate that approximates a real value ($q_{tot}$) thereof;

calculating a difference between the target value ($q^*_{tot}$) and the estimated value ($\hat{q}_{tot}$) of the fuel flow-rate;

using said difference to determine a value ($\Delta r^*$) of a correction term indicative of a deviation of the nominal function ($F_n$); and calculating the corrected value (r*) of the adjustable parameter as a function of the nominal value ($r_n$) thereof and of the calculated value ($\Delta r^*$) of the correction term.

2. A control apparatus according to claim 1, wherein the electronic control unit is configured to determine the value ($\Delta r^*$) of the correction term by:

calculating a derivative of the nominal function ($F_n$) at the point corresponding to the target value ($q^*_{tot}$) of the fuel flow-rate;

calculating a derivative of the nominal function ($F_n$) at the point corresponding to the estimated value ($q^*_{tot}$) of the fuel flow-rate; and calculating the correction term value ($\Delta r^*$) as a function of said derivatives and of the difference between the target value ($q^*_{tot}$) and the estimated value ($\hat{q}_{tot}$) of the fuel flow-rate.

3. The control apparatus according to claim 2, wherein the electronic control unit is configured to calculate the value ($\Delta r^*$) of the correction term by:

calculating an average between the derivatives of the nominal function ($F_n$) calculated at the points corresponding to the target value ($q^*_{tot}$) and to the estimated value ($\hat{q}_{tot}$) of the fuel flow-rate; and multiplying the calculated average for the difference between the target value ($q^*_{tot}$) and the estimated value ($\hat{q}_{tot}$) of the fuel flow-rate.

4. The control apparatus according to claim 3, wherein the electronic control unit is configured to calculate the average between the derivatives of the nominal function ($F_n$) as an harmonic mean thereof.

5. The control apparatus according to claim 1, wherein the electronic control unit is configured to estimate the value ($\hat{q}_{tot}$) of the fuel flow-rate by:

measuring a value (Y) of a fuel rail pressure; and determining the estimated value ($\hat{q}_{tot}$) of the fuel flow-rate on the basis of the measured value (Y) of the fuel rail pressure.

6. The control apparatus according to claim 5, wherein the electronic control unit is configured to determine the estimated value ($\hat{q}_{tot}$) of the fuel flow-rate using the measured value (Y) of the fuel rail pressure as input of a mathematical model that yields as output the estimated value ($\hat{q}_{tot}$) of the fuel flow-rate.

7. The control apparatus according to claim 5, wherein the electronic control unit is configured to determine the target value ($q^*_{tot}$) of the fuel flow-rate by:

setting a target value (Y*) for the fuel rail pressure;

calculating a difference between the target value (Y*) and the measured value (Y) of the fuel rail pressure; and calculating a feedback contribution ($q_{PI}$) to the target value ($q^*_{tot}$) of the fuel flow-rate as a function of the calculated difference.

8. The control apparatus according to claim 7, wherein the electronic control unit is configured to calculate the feedback contribution ($q_{PI}$) using the difference between the target value (Y*) and the measured value (Y) of the fuel rail pressure as input of a proportional-integrative controller (535) that yields as output the feed-back contribution ($q_{PI}$).

9. The control apparatus according to claim 7, wherein the electronic control unit is configured to determine the target value ($q^*_{tot}$) of the fuel flow-rate by:

calculating a feed-forward contribution ($q^*_L$) to the target value ($q^*_{tot}$) of the fuel flow-rate on the basis of the target value (Y*) of the fuel rail pressure; and adding the feed-forward contribution ($q^*_L$) to the feed-back contribution ($q_{PI}$) of the fuel flow-rate.

10. The control apparatus according to claim 9, wherein the electronic control unit is configured to calculate the feed-forward contribution ($q^*_L$) using the target value (Y*) of the fuel rail pressure as input of a mathematical model that yields as output the feed-forward contribution ($q^*_L$).

11. The control apparatus according to claim 1, wherein the adjustable parameter of the electric signal driving the actuator of the fuel metering valve is an electrical current.

12. The control apparatus according to any of the claims from 1, wherein the adjustable parameter of the electric signal driving the actuator of the fuel metering valve is a timing of a sequence of electrical current pulses forming the signal.

13. A method for operating a fuel metering valve associated to a fuel pump arranged to supply fuel into a fuel rail, the fuel metering valve having a valve member and an electric actuator arranged to move the valve member for regulating a fuel flow-rate supplied by the fuel pump into the fuel rail, the method comprising:

determining a target value ($q^*_{tot}$) for the fuel flow-rate;

using a nominal function ($F_n$) correlating values of the fuel flow-rate to corresponding values of an adjustable parameter of an electric signal driving the actuator of the fuel metering valve, to determine a nominal value ($r_n$) of the adjustable parameter that corresponds to the target value ($q^*_{tot}$) of the fuel flow-rate;

using the determined nominal value ($r_n$) to calculate a corrected value (r*) of the adjustable parameter; and setting the adjustable parameter of the electric signal at the corrected value (r*), wherein the corrected value (r*) of the adjustable parameter is calculated by:

estimating a value ($\hat{q}_{tot}$) of the fuel flow-rate that approximates a real value ($q_{tot}$) thereof;

calculating a difference between the target value ($q^*_{tot}$) and the estimated value ($\hat{q}_{tot}$) of the fuel flow-rate;

using said difference to determine a value ($\Delta r^*$) of a correction term indicative of a deviation of the nominal function ($F_n$); and calculating the corrected value (r*) of the adjustable parameter as a function of the nominal value ($r_n$) thereof and of the calculated value ($\Delta r^*$) of the correction term.

* * * * *